US008998589B2

(12) United States Patent
Lilie et al.

(10) Patent No.: US 8,998,589 B2
(45) Date of Patent: Apr. 7, 2015

(54) LINEAR COMPRESSOR

(75) Inventors: Dietmar Erich Bernhard Lilie, Joinville (BR); Paulo Rogerio Carrara Couto, Joinville (BR); Celso Kenzo Takemori, Joinville (BR); Egidio Berwanger, Joinville (BR)

(73) Assignee: Whirlpool S.A., São Paulo-Sp (BR)

( * ) Notice: Subject to any disclaimer, the term of this patent is extended or adjusted under 35 U.S.C. 154(b) by 469 days.

(21) Appl. No.: 13/382,440

(22) PCT Filed: Jul. 6, 2010

(86) PCT No.: PCT/BR2010/000224

§ 371 (c)(1),
(2), (4) Date: Mar. 22, 2012

(87) PCT Pub. No.: WO2011/003163

PCT Pub. Date: Jan. 13, 2011

(65) Prior Publication Data

US 2012/0177513 A1 Jul. 12, 2012

(30) Foreign Application Priority Data

Jul. 8, 2009 (BR) ..... 0902557

(51) Int. Cl.
*F04B 35/04* (2006.01)
*F04B 17/04* (2006.01)

(52) U.S. Cl.
CPC ..... *F04B 35/045* (2013.01)

(58) Field of Classification Search
CPC ..... F04B 35/045
USPC ..... 417/416, 417
See application file for complete search history.

(56) References Cited

U.S. PATENT DOCUMENTS 1,789,694 A * 1/1931 Beman ..... 417/416
1,996,160 A * 4/1935 Konig ..... 417/416
(Continued)

FOREIGN PATENT DOCUMENTS

WO WO-02090773 A1 11/2002
WO WO-2006069884 A1 7/2006
(Continued)

OTHER PUBLICATIONS

International Search Report dated Oct. 13, 2010, International Application No. PCT/BR2010/000224.

*Primary Examiner* — Alexander Comley
(74) *Attorney, Agent, or Firm* — Gifford, Krass, Sprinkle, Anderson & Citkowski, P.C.

(57) ABSTRACT

The linear compressor comprises a shell (10) which affixes a cylinder (20) defining a compression chamber (21) housing a piston (30); a linear electric motor (40) having a fixed part (41) affixed to the shell (10) and a reciprocating movable part (42); an actuating means (50) driven by the movable part (42); an elastic means (60*a*) coupling the actuating means (50) to the piston (30), so that they are reciprocated in phase opposition. A supporting elastic means (70) connects the actuating means (50) to the shell (10) and presents a radial rigidity for supporting the lateral loads actuating on said movable part (42) and actuating means (50), and for minimizing the axial misalignments between the movable part (42) and the fixed part (41) of the linear electric motor (40), the supporting elastic means (70) presenting a minimum axial rigidity for allowing the displacement of both the piston (30) and the actuating means (50).

6 Claims, 9 Drawing Sheets

(56) References Cited

U.S. PATENT DOCUMENTS

| | | | | | |
|---|---|---|---|---|---|
| 2,954,917 | A * | 10/1960 | Bayer | 417/417 |
| 3,490,684 | A * | 1/1970 | Meijer et al. | 417/417 |
| 3,947,155 | A * | 3/1976 | Bidol | 417/417 |
| 5,525,845 | A * | 6/1996 | Beale et al. | 310/30 |
| 5,779,455 | A * | 7/1998 | Steiger | 417/418 |
| 5,980,211 | A * | 11/1999 | Tojo et al. | 417/45 |
| 6,127,750 | A * | 10/2000 | Dadd | 310/13 |
| 6,129,527 | A * | 10/2000 | Donahoe et al. | 417/416 |
| 6,273,688 | B1 * | 8/2001 | Kawahara et al. | 417/417 |
| 6,540,490 | B1 * | 4/2003 | Lilie | 417/416 |
| 6,742,998 | B2 * | 6/2004 | Kawahara et al. | 417/416 |
| 6,884,044 | B2 * | 4/2005 | Lilie et al. | 417/363 |
| 7,153,108 | B2 * | 12/2006 | Puff et al. | 417/417 |
| 7,163,384 | B2 * | 1/2007 | Lilie et al. | 417/417 |
| 7,478,539 | B2 * | 1/2009 | Shapiro et al. | 62/175 |
| 2008/0089796 | A1 * | 4/2008 | Schade et al. | 417/417 |
| 2008/0118375 | A1 * | 5/2008 | Muth et al. | 417/363 |
| 2008/0134833 | A1 * | 6/2008 | Lilie et al. | 74/581 |
| 2009/0202373 | A1 * | 8/2009 | Williams et al. | 417/437 |

FOREIGN PATENT DOCUMENTS

| | | | | |
|---|---|---|---|---|
| WO | 2007118295 | A1 | 10/2007 | |
| WO | WO 2007118295 | A1 * | 10/2007 | F04B 35/04 |

* cited by examiner

LINEAR COMPRESSOR

CROSS REFERENCE TO RELATED APPLICATIONS

This application is the U.S. national phase of PCT/BR2010/000224, filed Jul. 6, 2010, which claims priority of Brazil Application PI 0902557-0, filed Jul. 8, 2009, which is incorporated herein by reference.

FIELD OF THE INVENTION

The present invention refers to a construction for a linear compressor and, more particularly, to a mounting arrangement for a linear compressor of the type generally used in small refrigeration systems, which allows distributing the forces transmitted from the compressor components to the shell to which the compressor is mounted. The present compressor can be constructed to be used not only in refrigeration systems of refrigeration appliances in general, but also for refrigerating the components of compact electronic appliances or other applications that require miniaturization of the compressor unit.

PRIOR ART

Linear compressors are known to be applied in refrigeration systems, and their construction has been object of researches generally aiming to improve the efficiency thereof. The linear compressor is basically a high vibration machine comprising a piston which is axially displaced in the interior of a compression chamber, in order to compress a determined mass of refrigerant gas of the refrigeration system during a refrigeration cycle of this system.

In the construction illustrated and described in Patent Application WO07/118,295 of the same applicant, it is presented a compact compressor of the type to be particularly, but not exclusively, utilized to refrigerate electronic systems, said compressor generically comprising a generally hermetic shell 10 presenting a typical cylindrical shape; a cylinder 20, affixed to the shell 10 and defining a compression chamber 21 in the interior of which a piston 30 is axially displaced, in a reciprocating movement, during the operation of the compressor; a linear electric motor 40 mounted to the shell 10; an actuating means 50 operatively coupling the piston 30 to the linear electric motor 40, so as to make the latter displace the piston 30 in a reciprocating movement inside the compression chamber 21, said actuating means 50 being coupled to the piston 30 by means of a coupling means 60, in the form of an elastic means 60*a*, designed so that the actuating means 50 and the piston 30 are displaced in phase opposition during the operation of the compressor, as exposed hereinafter.

This embodiment requires a slide bearing M to guide the movable part of the motor in the interior of the shell during the compressor operation, preventing lateral movements of said movable part of the motor from unbalancing the compressor unit. However, this type of bearing generates friction and presents a limited lifetime as a function of its wear, since the compressors of the type considered herein are designed not to use oil for lubricating parts in relative movement. Another problem related to the use of slide bearings is the generation of noise; the bearing can generate noise in cases in which contact occurs between the movable parts.

Considering the reduced dimensions available in compact compressors, particularly for application in refrigeration systems of electronic appliances, it is desirable to provide a constructive solution which guarantees miniaturizing the compressor unit and, preferably, suppressing the slide bearings, minimizing the existence of parts with relative movement and in contact with each other in the compressor, and simplifying the construction thereof, without compromising the limitations established for dimensioning the linear compressor.

SUMMARY OF THE INVENTION

As a function of the drawback commented above and other disadvantages of the known constructive solutions, it is one of the objects of the present invention to provide a linear compressor which allows minimizing or even annulling the effects of the lateral loads actuating on the reciprocating parts of the compressor in the interior of the shell thereof, preventing the movable components of the compressor unit, particularly the assembly formed by the actuating means and by the movable part of the motor, from colliding with the compressor shell, without using slide bearings or other means that can cause contact between the movable parts of the compressor.

Another object of the present invention is to provide a compressor as cited above and which does not generate noise during its operation.

Another object of the present invention is to provide a compressor as cited above and which allows, in a simple manner, the construction of a compact linear compressor (of the type disclosed in WO07/118,295) which annuls, at least in part, the effects of the lateral loads actuating on the piston in the interior of the compression chamber, minimizing the friction between said parts.

A further object of the present invention is to provide a compressor as cited above and which permits, in a simple manner, the construction of a compact linear compressor, without requiring the use of lubricant oil between the parts with relative movement.

Another object of the present invention is to provide a linear compressor as cited above and whose construction permits maintaining the dimensions of the compressor shell, as well as the overall weight of the latter with reduced values.

The present invention refers to a linear compressor of the type which comprises: a shell which internally affixes a cylinder defining a compression chamber in whose interior a piston is provided; a linear electric motor having a fixed part affixed internally to the shell and a movable part reciprocating in relation to the fixed part; an actuating means affixed to the movable part of the linear electric motor, so as to be driven by said movable part in a reciprocating movement; a coupling means, coupling the actuating means to the piston, so that said actuating means and piston are displaced in a reciprocating movement during the compressor operation.

According to the invention, the compressor comprises a supporting elastic means connecting the actuating means to the shell and presenting a radial rigidity capable to support the lateral loads actuating on the assembly defined by the movable part of the linear electric motor and by the actuating means, so as to minimize axial misalignments between said fixed and movable parts of the linear electric motor, resulting from the effects of said lateral loads, said supporting elastic means presenting a minimum axial rigidity, so as to allow the desired displacement of the piston and of the actuating means.

According to a particular aspect of the present invention, in which the coupling means is an elastic means which couples the actuating means to the piston, the supporting elastic means presents a minimum axial rigidity, so as to allow the piston and the actuating means to present a displacement in phase opposition.

According to another particular aspect of the present invention, in which the piston is directly coupled to the elastic means, the compressor comprises an additional supporting elastic means connecting the piston to the shell and presenting a radial rigidity capable to support the lateral loads actuating on the piston, so as to minimize axial misalignments of the piston in relation to the compression chamber, resulting from the effects of said lateral loads, said additional supporting elastic means presenting a minimum axial rigidity, so as to allow the desired displacement, in phase opposition, of the piston and of the actuating means.

In another aspect of the present invention, the compressor comprises an additional supporting elastic means connecting, to the shell, an end portion of the elastic means, adjacent to the piston and presenting a radial rigidity capable of supporting the lateral loads actuating on said end portion of the elastic means, so as to minimize axial misalignments of the end portion of the elastic means in relation to the compression chamber, resulting from the effects of said lateral loads, said additional supporting elastic means presenting a minimum axial rigidity, so as to allow the desired displacement, in phase opposition, of the piston and of the actuating means.

Still another aspect of the present invention is to provide a linear compressor as defined above and in which the piston is rigidly coupled to the elastic means, or said piston is coupled to the elastic means by an articulation means.

BRIEF DESCRIPTION OF THE DRAWINGS

The invention will be described below, with reference to the enclosed drawings, given by way of example of possible embodiments of the present invention and in which.

DESCRIPTION OF THE ILLUSTRATED EMBODIMENTS

Figure 1:
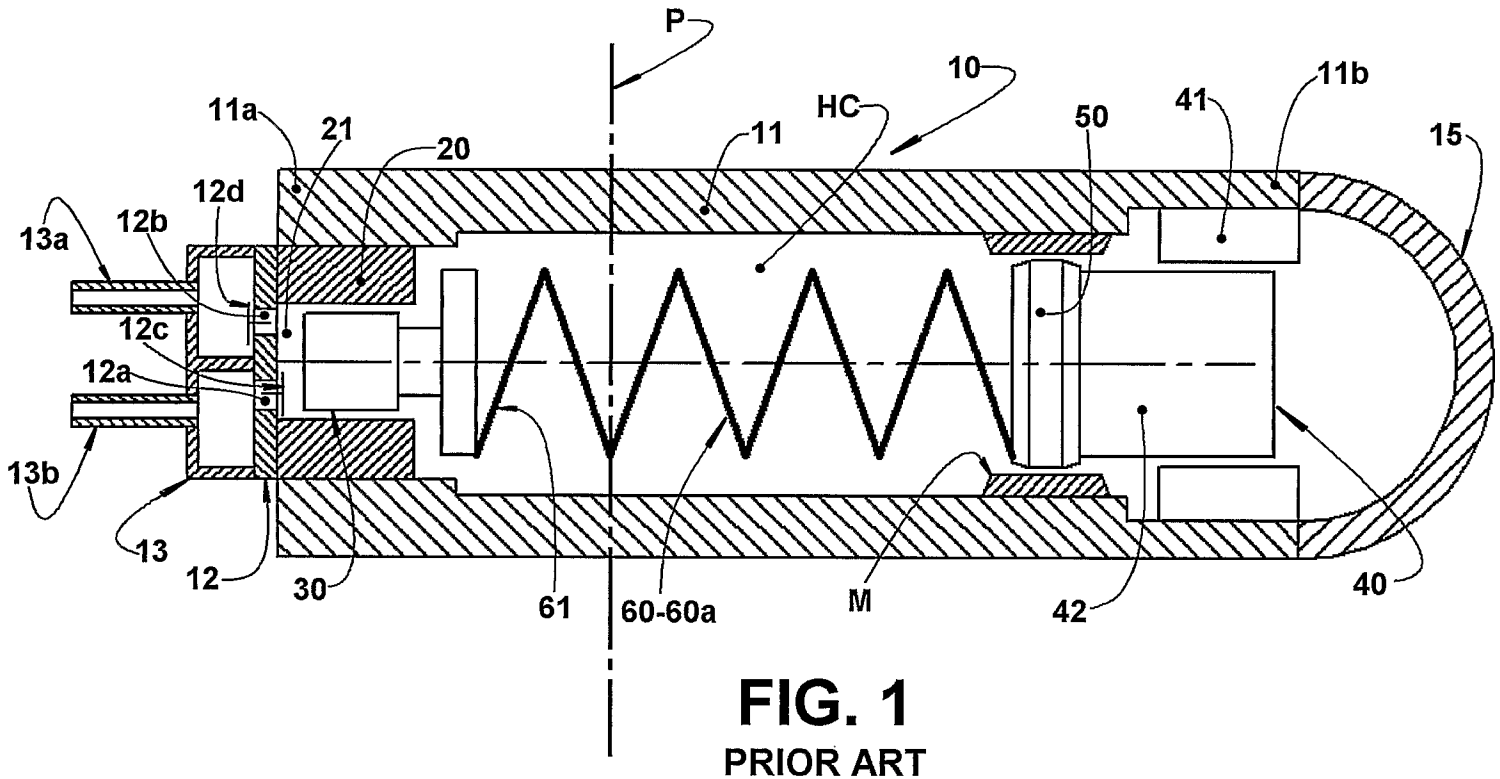
FIG. 1 PRIOR ART
FIG. 1 schematically represents a longitudinal sectional view of a construction of the linear compressor described and illustrated in WO07/118,295.

As illustrated in FIGS. 1, 2, 3, 4, 5 and 7, the present invention comprises a compressor for refrigeration systems, for example, a compact compressor of the type to be particularly, but not exclusively, utilized to refrigerate electronic systems, said compressor generally comprising a shell 10; a cylinder 20 internally affixed to the shell 10 and defining a compression chamber 21; a piston 30 reciprocating in the interior of the compression chamber 21 during the operation of the compressor; a linear electric motor 40 having a fixed part 41 internally affixed to the shell 10 and a movable part 42 reciprocating in relation to the fixed part 41; and an actuating means 50 affixed to the movable part 42 of the linear electric motor 40, so as to be driven by said movable part in a reciprocating movement. The actuating means 50 is coupled to the piston 30 by a coupling means 60, so that said actuating means 50 and piston 30 are displaced, in a reciprocating movement during the operation of the compressor.

The piston 30, the actuating means 50, the movable part 42 of the linear electric motor 40 and the elastic means **60*a*** define a resonant movable assembly of the compressor.

In a particular compressor construction, such as that described in co-pending Patent Application WO07/118,295 and to which the present invention is applied, the actuating means 50 is coupled to the piston 30 through a coupling means 60 in the form of an elastic means **60*a*, so that said actuating means 50 and piston 30** are displaced, in a reciprocating movement and in phase opposition, during the operation of the compressor.

Although not illustrated, the present invention can be also applied to a linear compressor which presents the actuating means 50 and the piston 30 constructed to be coupled to each other through a coupling means 60, for example, in the form of a rod or a bundle of rods, so as to be jointly displaced, in phase, upon the reciprocating movement thereof.

In this construction, illustrated in the appended drawings and in which the piston 30 is not directly and rigidly affixed to the actuating means 50, but through an elastic means **60*a* (causing a reciprocating displacement that does not correspond to the reciprocating displacement of the actuating means 50), the reciprocating movement of the piston 40 is operatively associated with that movement determined for the actuating means 50 by the linear electric motor 40, allowing said piston 30 to present a displacement which is offset or in phase opposition, that is, in a direction opposite to that of the actuating means 50, which displacement may also present an amplitude different from that of the reciprocating displacement of the actuating means 50. This freedom of movement between the piston 30 and the actuating means 50 allows the relative reciprocating displacements to be previously defined, in order to annul the vibrations, in the direction of the reciprocating movement, caused by the displacement of each of said parts. In this type of construction, the displacement amplitudes of the piston 30 are smaller than those associated with the actuating means 50, as a function of the different masses of the two parts associated with the elastic means 60*a***.

The elastic means **60*a*, which operatively couples the piston to the actuating means 50 in the illustrated constructions, is defined not only to guarantee the physical coupling between the parts of piston 40 and actuating means 50, but also to determine the transfer of movement from the linear electric motor 40 to the piston 30, in a determined amplitude, frequency and phase relation with the movement of the actuating means 50**.

The elastic means 60*a* presents an axis coaxial to the displacement axis of the piston 30 and is dimensioned as a function of the masses of the piston 30 and of the actuating means 50, and of the desired displacement amplitudes that are predetermined for said parts of actuating means 50 and piston 30. The displacement amplitudes of both the piston 30 and the actuating means 50 are defined in relation to a transversal plane P, orthogonal to the axis of the elastic means 60*a*, defined at a predetermined distance in relation to a reference point contained in one of the parts of cylinder 20 and shell 10, said amplitudes being calculated to guarantee a determined power for the linear electric motor 50 and a determined gas pumping efficiency for the piston 30.

The elastic means 60*a*, coupled to the parts of piston 30 and actuating means 50, maintains stationary its region disposed on said transversal plane P, defining a point zero of the amplitude of the compressor operation, in which the vibration caused by the movement of each of the parts of piston 30 and actuating means 50 presents a null resultant, independent of the difference between the amplitudes being balanced.

The determination of the travel amplitude of both the piston 30 and the actuating means 50 is made by determining the masses and the spring constant of the elastic means 60*a*.

In the compressor constructions in which the travel of the piston 30 is not modified, the displacement amplitude of the actuating means 50 is defined so as to be greater than the displacement amplitude of the piston 30, allowing the desired power to be obtained with an electric motor of reduced dimensions, for example, of smaller diameter, but without the necessary increase of the travel of the actuating means 50 provoking alteration in the travel of the piston 30 and, consequently, in the pumping capacity thereof.

According to a constructive form of the compressor described herein and presented in WO07/11829, the actuating means 50 generally comprises a base portion defined by the movable part 42 of the linear electric motor 40, said base portion and load portion being preferably coaxial to one another and to the axis of the piston 30. In a way of carrying out the present invention, the base portion secures the load portion by a known conventional way, such as adhesive, threads, interference, etc, or incorporates said load portion in a single piece. The load portion (movable part 42 of the linear electric motor 40) carries permanent magnets (not illustrated) of the linear electric motor 40.

For the construction described herein, the elastic means 60*a* has an end affixed to the piston 30 and an opposite end affixed to the base portion of the actuating means 50. The elastic means 60*a* can be defined by one or two resonant helical springs with the same helical development direction and having their adjacent ends angularly spaced from each other.

The compressor described herein can comprise or not a positioning element (not illustrated) coupling the region of the elastic means 60*a*, situated on said transversal plane P, to one of the parts of cylinder 20 and shell 10.

For the present compressor construction, the elastic means 60*a* comprises at least one resonant helical spring with an end coupled to the piston 30 and an opposite end coupled to the actuating means 50. In the constructions in which the elastic means 60*a* comprises more than two resonant helical springs, these present an angular distribution defining a plane of symmetry (for example with the same spacing) for the adjacent ends of said resonant helical springs.

In the construction illustrated in FIG. 1, the shell 10 presents, internally, a slide bearing M, which guarantees the alignment of the movable part 42 of the linear electric motor 40 during the operation of the compressor, but which presents the already previously discussed deficiencies.

According to the present invention, in which the slide bearing is not used anymore, the compressor comprises a supporting elastic means 70 connecting the actuating means 50 to the shell 10 and presenting a radial rigidity capable to support the lateral loads actuating on the assembly defined by the movable part 42 of the linear electric motor 40 and by the actuating means 50, so as to minimize axial misalignments between said movable part 42 and fixed part of the linear electric motor 40, resulting from the effects of said lateral loads, said supporting elastic means 70 presenting a minimum axial rigidity, so as to allow the desired displacement, in phase opposition, of the piston 30 and the actuating means 50.

The compressor of the present invention can also comprise an additional supporting elastic means 80, coupling one of the parts of piston 30 and elastic means 60*a* to the shell 10, in the region in which said elastic means 60*a* is mounted to the piston 30.

The constructive forms and the degree of axial and radial rigidity of each of the parts of supporting elastic means 70 and additional supporting elastic means 80 may or may not be equal, the form and the degree of axial and radial rigidity of each of said supporting elastic means being defined as a function of the involved masses and the convenience of annulling the resultant of the forces that said supporting elastic means 70, 80 exert on the elastic means 60*a*.

The supporting elastic means 70 and the additional supporting elastic means 80 may be designed so that each present a respective axial rigidity defined so as to annul, jointly with the axial rigidity of the other of said elastic means, the axial forces on the shell 10 during reciprocation of the piston 30 and of the assembly formed by the actuating means 50 and the movable part 42 of the motor 40, upon operation of the compressor According to a way of carrying out the present invention, the supporting elastic means 70 is defined by at least one spring 71 disposed in a plane orthogonal to the axis of the fixed part 41 of the linear electric motor 40. In a variant of this solution, not illustrated, the supporting elastic means 70 comprises at least one spring 71 having part of its extension, for example that part to be affixed to the shell 10, disposed in a plane orthogonal to the axis of the fixed part 41 of the linear electric motor 40, the remainder of said spring 71 being disposed angularly to said axis of the fixed part 41 of the linear electric motor 40, defining a conical shape to said spring 71.

In the construction illustrated in FIGS. 2 to 6, the supporting elastic means 70 is defined by a single flat spring 71, for example comprising two concentric annular portions 72*a*, 72*b*, wherein concentric annular portion 72*a* defines an outer radial edge and concentric annular portion 72*b* defines an inner radial edge of the single flat spring 71, the outer radial edge 72*a* and the inner radial edge 72*b* are interconnected by a plurality of intermediary portions 73, in a spiral arrangement.

This embodiment of flat spring 71 is defined to present low axial rigidity and high radial rigidity. Moreover, it can be easily obtained, by cutting or stamping a flat metal sheet. Another advantage of this embodiment is its length in the axial direction. Since it is obtained from a metal sheet, the axial dimension is significantly reduced.

According to another way of carrying out the present invention, as illustrated in FIGS. 7 to 10, the supporting elastic means 70 is defined by at least one cylindrical helical spring 74, coaxial to the axis of the fixed part 41 of the linear electric motor 40 and having an end 74*a* coupled to the actuating means 50 and an opposite end 74*b* coupled to the shell 10. The cylindrical helical spring 74 can be mounted in an end region of the elastic means 60*a*, adjacent to the actuating means 50, surrounding said end region of the elastic means 60*a* or also disposed internally to said elastic means 60*a*. In the embodiment illustrated in FIG. 7, the cylindrical helical spring 74 is mounted surrounding said end region of the elastic means 60*a* and has its opposite end 74*b* mounted seated against a stop portion 10*a* internally provided in the shell 10.

In this embodiment of supporting elastic means 70 in the form of a cylindrical helical spring 74, said supporting elastic means 70 can be defined by one or more helical springs configured to present high radial rigidity and low axial rigidity. The advantage of this embodiment is its radial dimension, which enables reducing the lateral dimensions of the compressor, which can thus be compacted.

In the construction of helical springs, the cylindrical helical spring 74 can be obtained in a single piece with the spring which defines the elastic means 60*a* (FIG. 10) or provided in a piece separated from the latter.

According to the illustrations, the shell 10 comprises an elongated tubular body 11, generally in metallic alloy and internally defining a hermetic chamber HC between the linear electric motor 40 and the cylinder 20, said hermetic chamber HC being open to a first end of the compression chamber 21 and lodging the actuating means 50 and the elastic means 60*a*.

A valve plate 12, of any known prior art construction, is seated and secured against a second end of the compression chamber 21, closing it.

A head 13 is externally seated and retained against the valve plate 12, providing selective fluid communications between the compression chamber 21 and the suction line 13*a* and discharge line 13*b* of a refrigeration circuit, not illustrated, to which the compressor is coupled.

According to the present invention, the head 13 (or also an end cover secured around at least part of the longitudinal extension of the adjacent shell portion surrounding the valve plate 12) is affixed, for example, through adhesives or mechanical interference, to the shell 10.

The valve plate 12, in which a suction orifice 12*a* and a discharge orifice 12*b* are defined selectively closed by a respective suction valve 12*c* and a respective discharge valve 12*d*, is seated against the second end of the compression chamber 21, closing said compression chamber 21, said second end of the compression chamber 21 being opposed to the one to which the piston 30 is mounted.

In the compressor construction presenting a shell 10, as illustrated in the enclosed drawings, said compressor presents the relatively moving parts thereof constructed to dispense the provision of lubricant oil for the compressor, as well as of a reservoir for said oil and means for pumping it to the parts with relative movement. The relatively moving parts of the compressor are made of a self-lubricant material, such as, for example, some plastics, or made of an antifriction material, or provided with a low friction wear-resistant coating.

In particular, the piston 30 can be produced in a self-lubricant material, such as, for example, some engineering plastics, or in conventional materials coated with low friction wear-resistant surface coating. The compression chamber 21, inside which occurs the displacement of the piston 30, may also receive a sleeve with a coating such as cited above.

Besides reducing the friction between the relatively moving parts, the determination of the material that forms the components of the compressor of the present invention considers balancing issues in the compressor. Within this concept, the compressor being described preferably presents its components made of a material with low mass density, in order to reduce the unbalancing forces coming from the reciprocating movement of the piston 30.

The compressor being described can be utilized in a wide range of rotations, for example from 3.000 rpm to 15.000 rpm, as a function of its characteristics.

Although the constructions illustrated herein present a fluid communication between the compression chamber 21 and the suction line through a head 13, it should be understood that the present invention can be also applied to compressor constructions, such as those described and illustrated in WO07/118,295.

As illustrated, the elongated tubular body 11 of the shell presents a first end 11*a*, to which the head 13 is affixed and a second end 11*b*, closed by a motor cover 15. In the prior art construction illustrated in FIG. 1, the linear electric motor 40 is mounted adjacent to the second end 11*b* of the elongated tubular body 11 of the shell 10.

It should be understood that, for any of the shell constructions described herein or also for those constructions presented in WO07/118,295, at least one of the parts of shell 10 and motor cover 15 may also be externally provided with heat exchange fins, for refrigerating the present compressor during operation and for releasing, to the outside of the compressor, the heat that is generated by the motor and by compression of the refrigerant fluid in the compression chamber 21.

Figure 2:
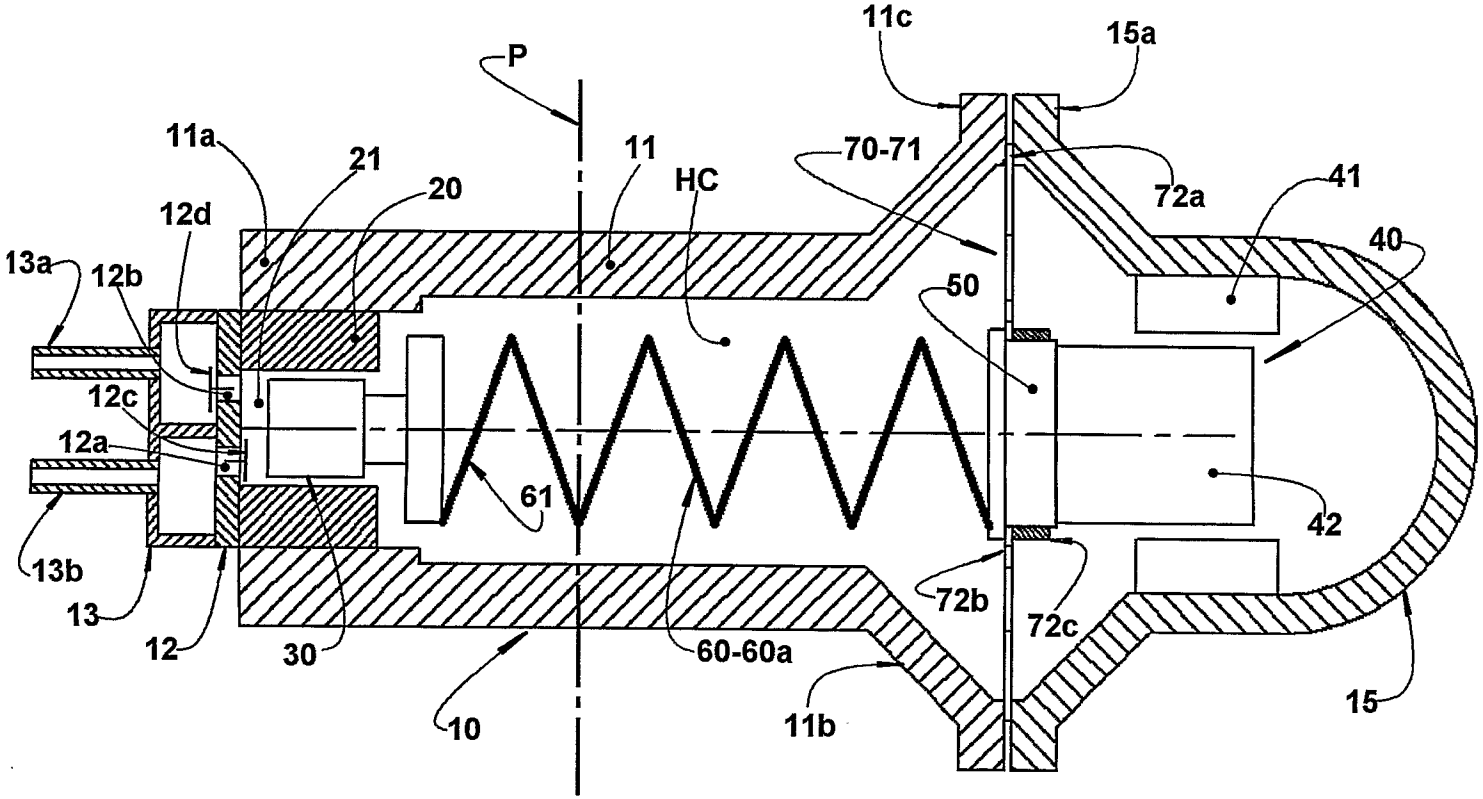
FIG. 2 represents, in a simplified and rather schematic way, a longitudinal sectional view of a compressor of the type illustrated in FIG. 1, but presenting a first embodiment of the present invention for the supporting elastic means.
Figure 3:
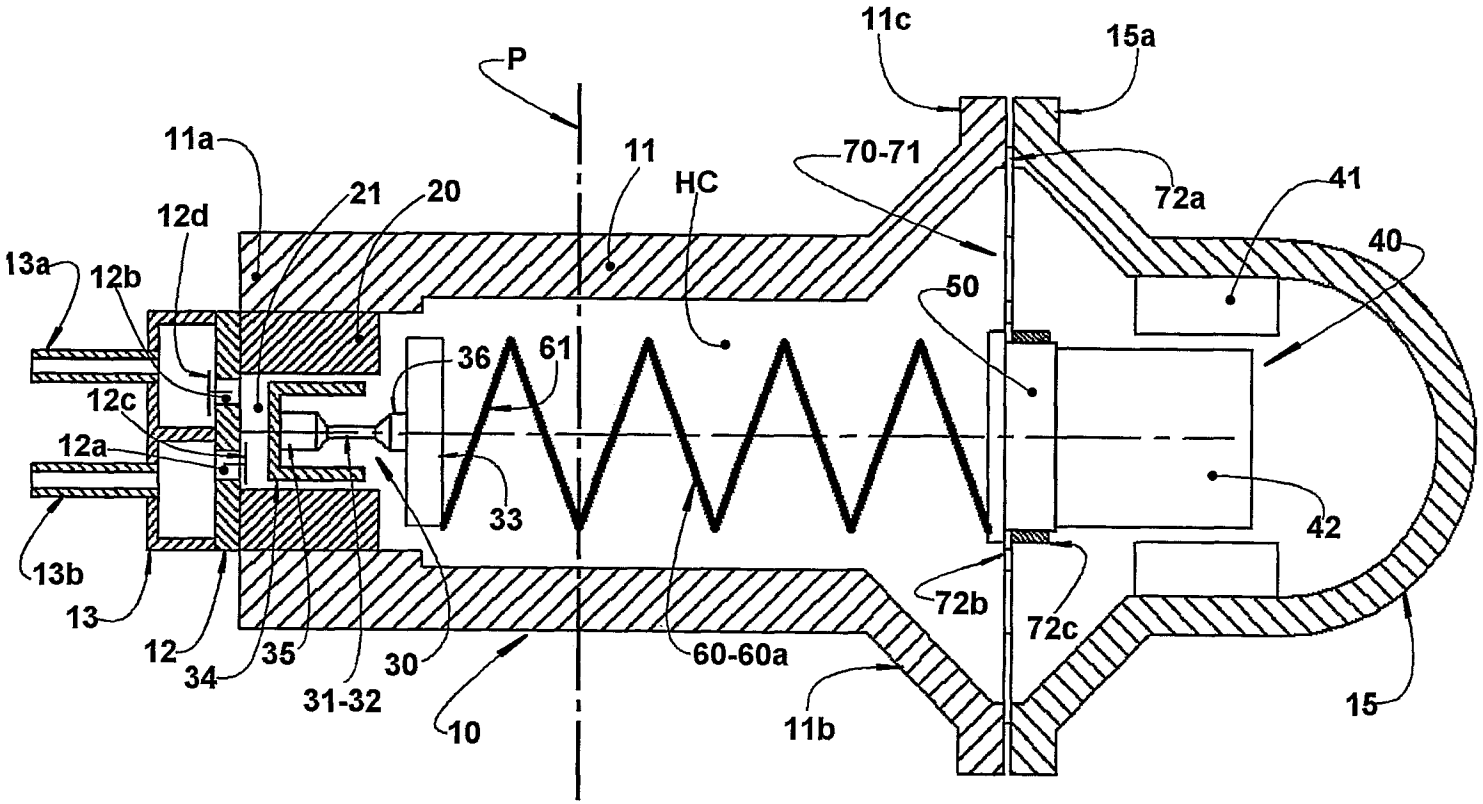
FIG. 3 schematically represents a constructive variant for mounting the piston to the elastic means, for the solution illustrated in FIG. 2, using an additional supporting elastic means.

According to a way of carrying out the present invention, as illustrated in FIGS. 2 and 3, the shell 10 is formed in at least two coaxial portions hermetically affixed to each other, one of which defining the elongated tubular body 11 of the shell 10 and, the other, the motor cover 15. For the construction of the supporting elastic means 70 in the form of a flat spring 71, this presents a radially external portion defined by an outer annular portion 72*a*, affixed between said two shell portions.

In this construction, the second end 11*b* of the elongated tubular body 11 presents a peripheral flange 11*c* to be seated against a peripheral flange 15*a* of an open end portion of the motor cover 15, sandwiching a peripheral edge of the outermost annular portion 72*a* of the flat spring 71, which defines the supporting elastic means 70 in this construction, by appropriate means and using sealing joints to guarantee the hermeticity of the interior of the shell 10.

In the constructions illustrated in FIGS. 2 to 5, the innermost annular portion 72*b* of the flat spring 71, comprises a central hub 72*c* to be tightly mounted around an adjacent portion of the actuating means 50.

In these constructions, the shell 10 presents an enlargement in the fixation region of the motor cover 15, as a function of the diameter of the supporting elastic means 70.

The flat spring 71 illustrated in FIGS. 2 to 6 has its concentric annular portions 72*a*, 72*b* interconnected by a plurality of intermediary portions 73, in a spiral arrangement, defined between slots 75 produced in the same spiral development direction, said slots being dimensioned as a function of the rigidity desired for this construction of supporting elastic means 70.

According to another aspect of the present invention, to be applied in the constructions in which the piston 30 is directly coupled to the elastic means 60*a*, the present compressor comprises an additional supporting elastic means 80, connecting the piston 30 to the shell 10 and presenting a radial rigidity capable to support the lateral loads actuating on the piston 30, so as to minimize axial misalignments of the piston 30 in relation to the compression chamber 21, resulting from the effects of said lateral loads, said additional supporting elastic means 80 presenting a minimum axial rigidity, so as to allow the desired displacement in phase opposition of the piston 30 and of the actuating means 50. In this construction, the additional supporting elastic means 80 minimizes the occurrence, during the compressor operation, of impacts and friction between the piston 30 and the inner wall of the compression chamber 21.

Further according to another aspect of the present invention, the compressor comprises an additional supporting elastic means 80 connecting, to the shell 10, an end portion 61 of the elastic means 60*a*, adjacent to the piston 30 and presenting a radial rigidity capable to support the lateral loads actuating on said end portion 61 of the elastic means 60*a*, so as to minimize axial misalignments of the end portion 61 of the elastic means 60*a* in relation to the compression chamber 21, resulting from the effects of said lateral loads, said additional supporting elastic means 80 presenting a minimum axial rigidity, so as to allow the desired displacement in phase opposition of the piston 30 and of the actuating means 50.

Figure 4:
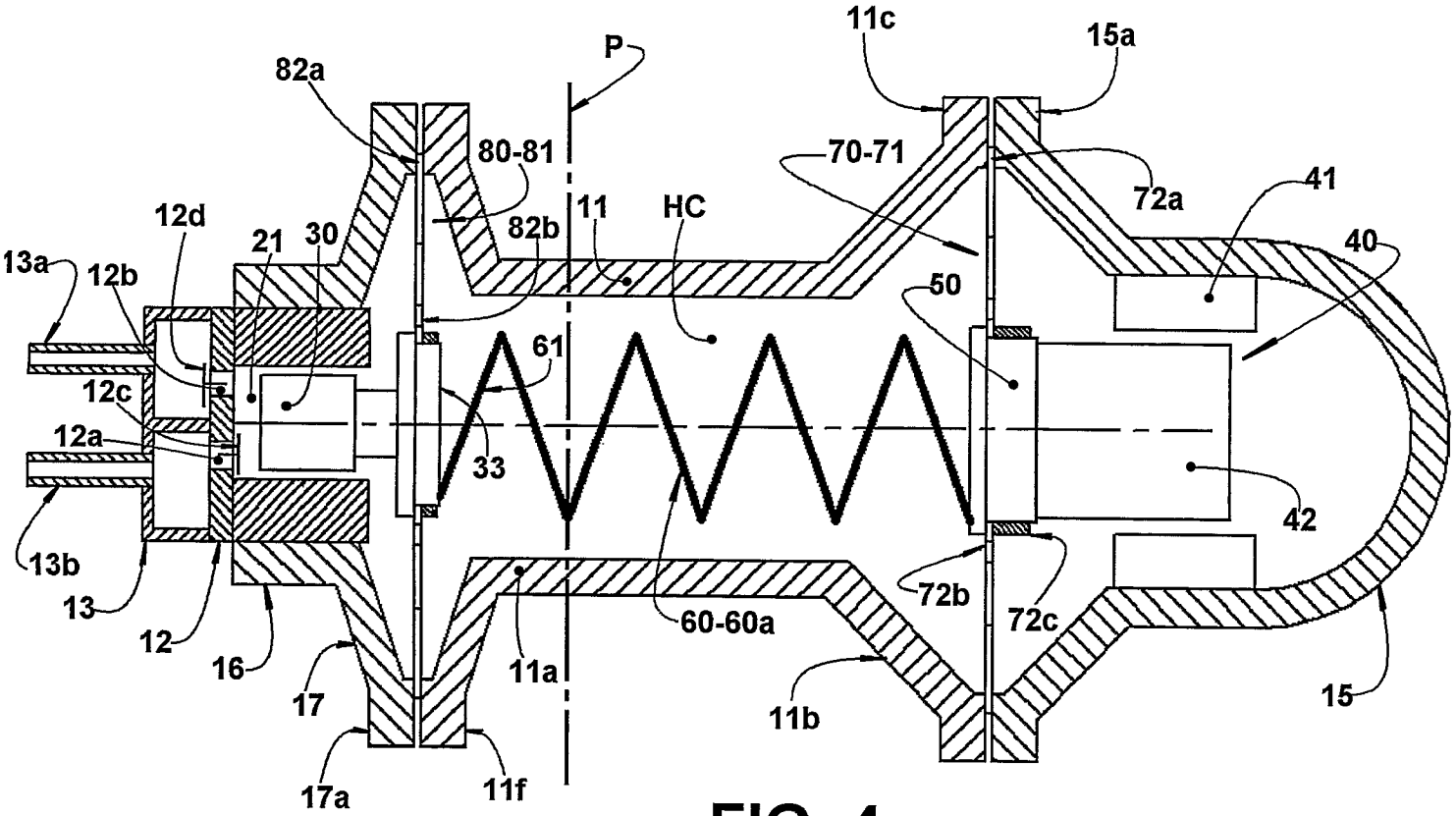
FIG. 4 schematically represents a view such as that of previous figures, for a second constructive option of the present invention.
Figure 5:
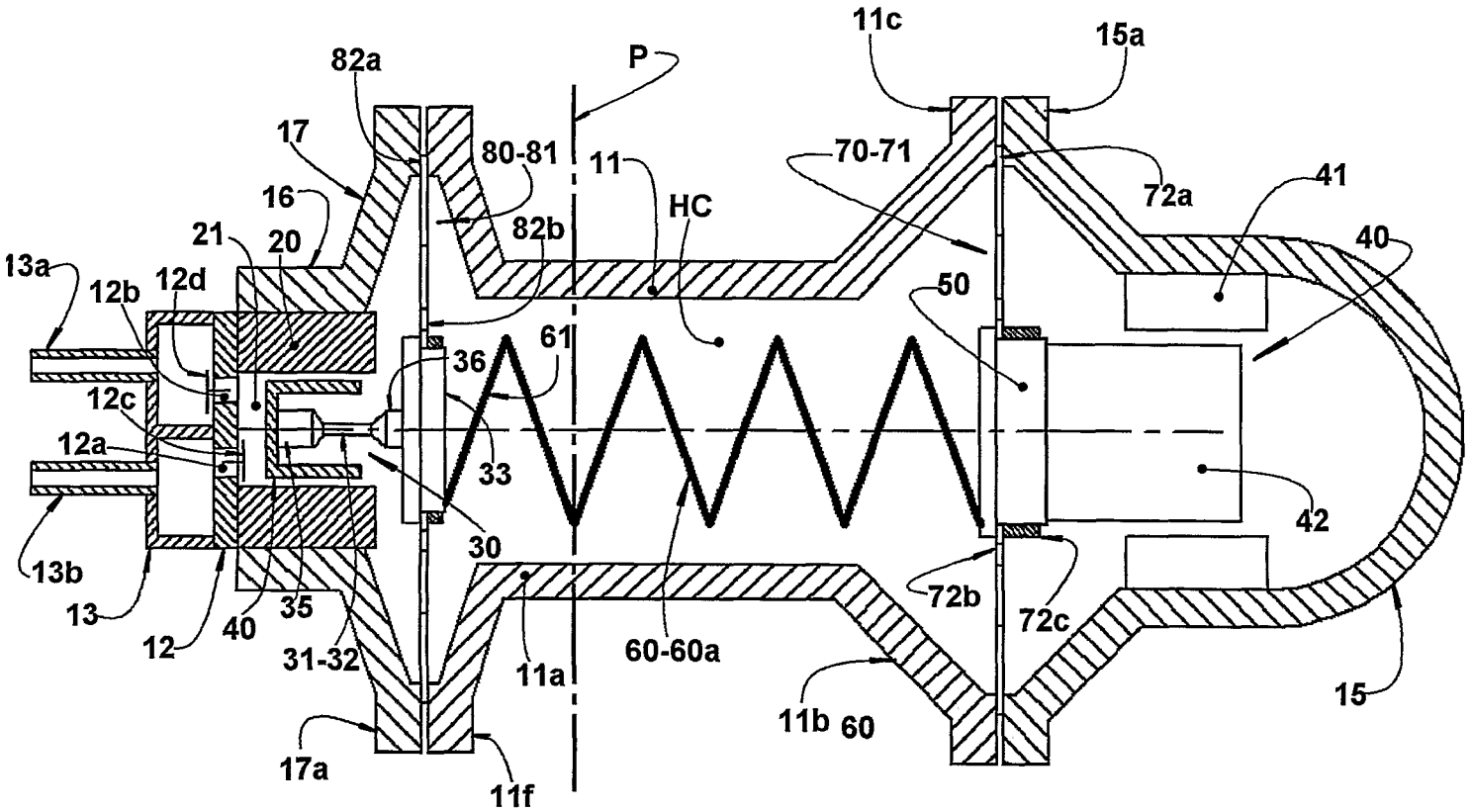
FIG. 5 schematically represents a constructive variant for mounting the piston to the elastic means, for the solution illustrated in FIG. 4.
Figure 6:
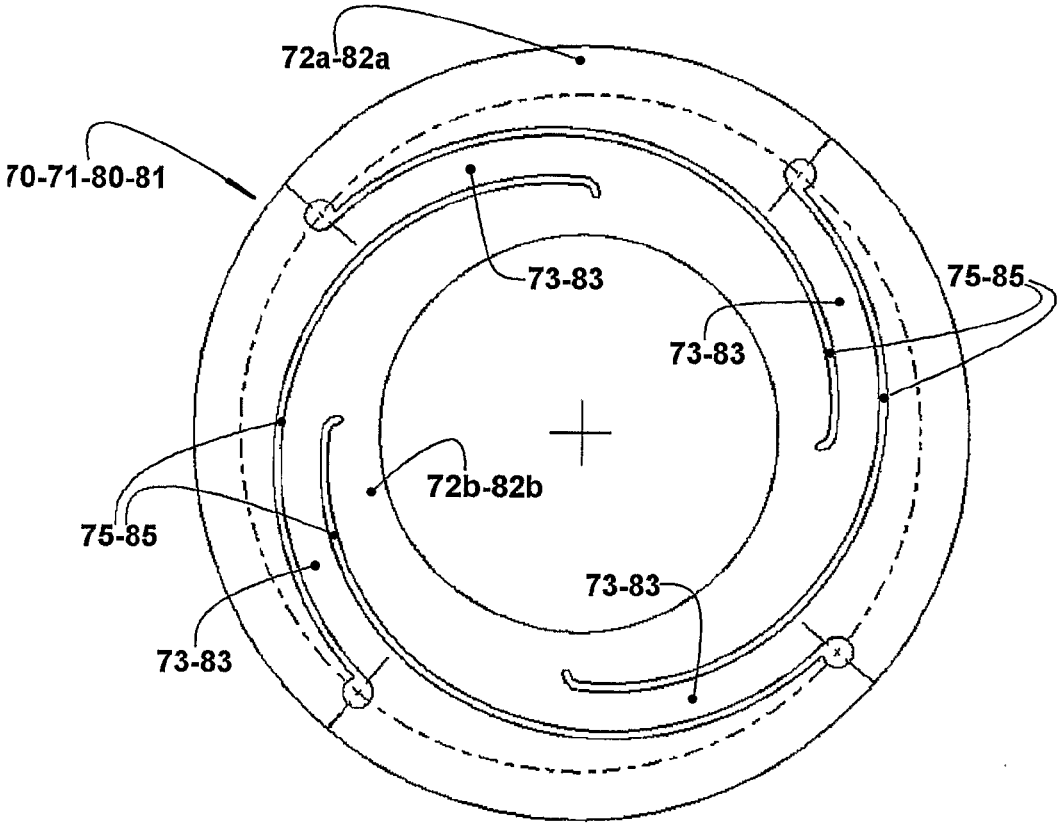
FIG. 6 schematically represents a constructive option for the supporting elastic means of the present invention, of the type illustrated in FIGS. 2 to 5.
Figure 7:
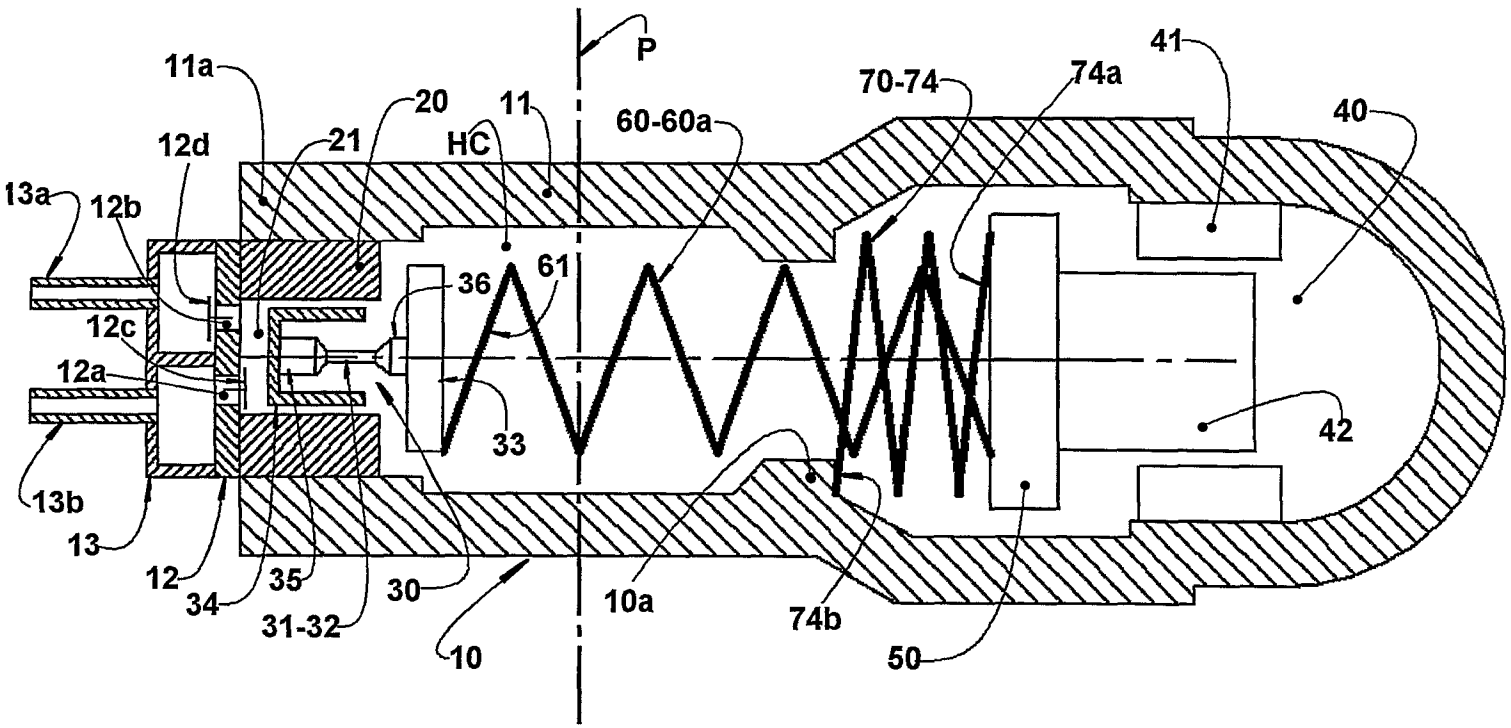
FIG. 7 schematically represents a view such as that of the previous FIGS. 1 to 5, for a third constructive option of the present invention.
Figure 8:
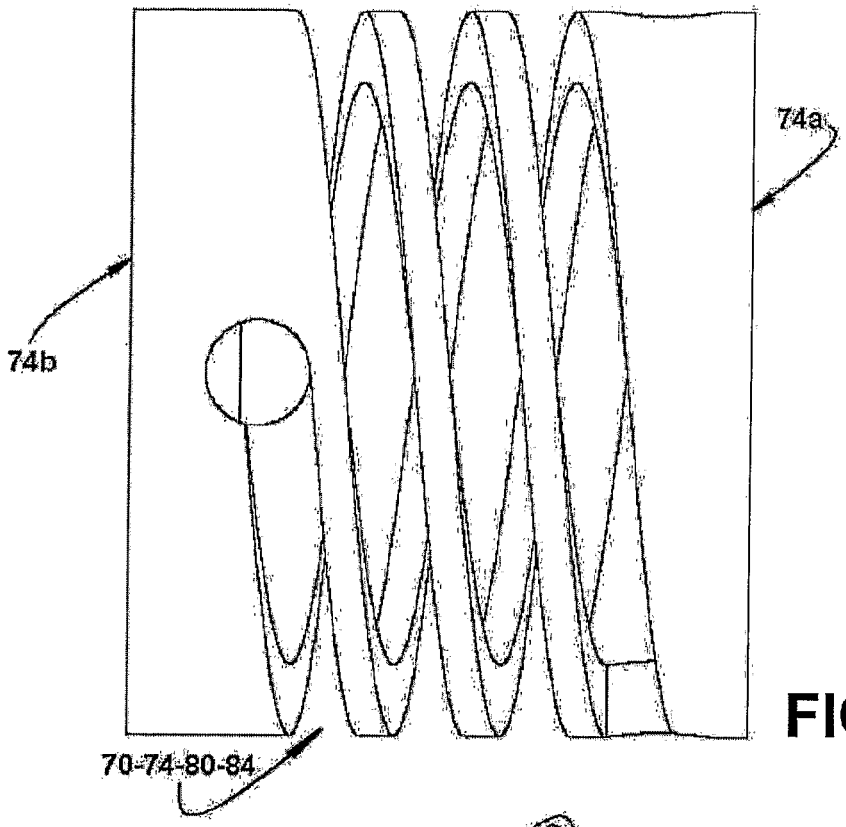
FIG. 8 schematically represents a lateral view of a second constructive option for the supporting elastic means.

For this construction, the piston 30 can be rigidly coupled to the elastic means 60*a*, as illustrated in FIGS. 2 and 4, or coupled to the elastic means 60*a* by an articulation means 31, as illustrated in FIGS. 3, 5 and 7.

Figure 10:
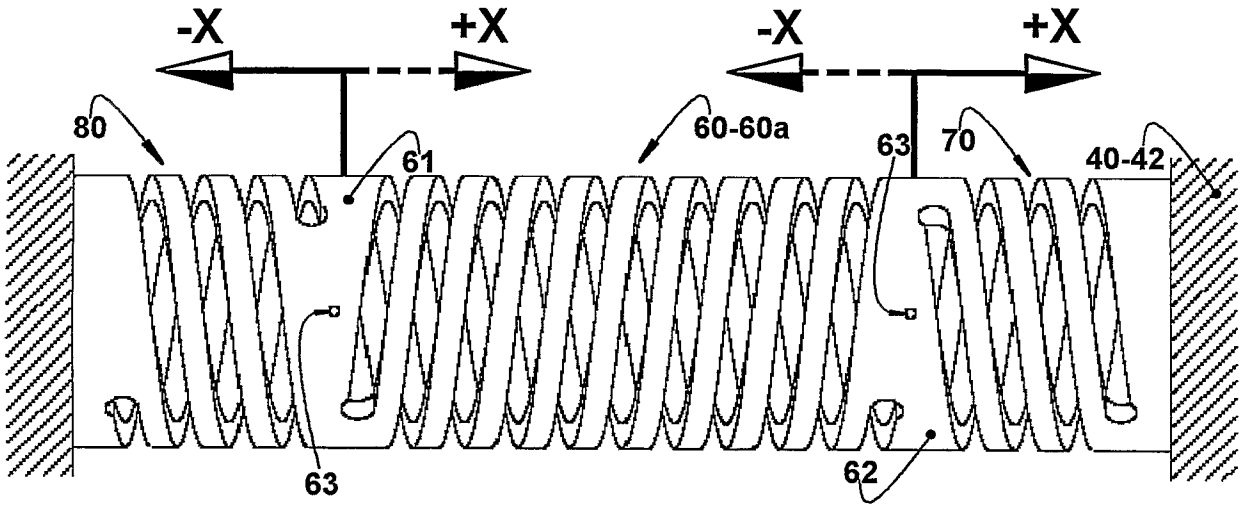
FIG. 10 schematically represents a view such as that of FIG. 8, for a fourth constructive option of the present invention, indicating, in continuous lines, an expansion condition of the supporting elastic means and, in dashed lines, a compression condition of the latter.

FIG. 10 illustrates a construction utilizing a supporting elastic means 70 and an additional supporting elastic means 80, both provided as spring extensions of the elastic means 60*a*, particularly in a single piece with the latter, from the end portion 61 of the elastic means 60*a* and from an opposite end portion 62 of the latter, adjacent to the movable part 42 of the linear electric motor 40.

In this construction, each supporting elastic means 80 is coupled to the shell 10 through, respectively, the end portion 61 and the opposite end portion 62 of the elastic means 60*a*. In the illustrated construction, in each said end portion 61 and opposite end portion 62, the spring means is provided with a hole 63 for affixing the two supporting elastic means to the shell 10.

Due to this connection to the elastic means 60*a*, the two supporting elastic means, in this construction, are also submitted to the operational movement of the elastic means 60*a*. In order to prevent such two supporting elastic means from interfering in the operation of the elastic means 60*a*, the axial rigidity thereof is calculated considering the axial rigidity of each said supporting elastic means. The supporting elastic means are constructed to present a spring wire with a reduced thickness in the axial direction and a larger thickness in the radial direction, in order to allow obtaining the desired operational behavior for said supporting elastic means. It should be understood that the radial rigidity and the axial rigidity of the supporting elastic means 70 and of the additional supporting elastic means 80 are defined as a function of the loads to which the supporting elastic means 70 or the additional supporting elastic means 80 will be submitted during the compressor operation.

The provision of the articulation means 31 allows preventing that deviations of the elastic means 60*a* in relation to the piston 30 are transmitted to the latter, which deviations are caused by radial vibrations, resulting from the compression and suction operations of the compressor, and also by possible mounting misalignments (imperfections) of the additional supporting elastic means 80.

In the construction illustrated in FIGS. 3, 5 and 7, the articulation means 31 includes a rod 32 connecting a base portion 33 to a top portion 34 of the piston 30, responsible for the gas compression in the compression chamber 21, said rod 32 being connected between the base portion 33 and the top portion 34 through respective articulations 35, 36, such as, for example, a ball-joint means or an articulated engaging means.

The additional supporting elastic means 80 can present the same constructions already described for the supporting elastic means 70, that is, said additional supporting elastic means 80 can be defined by at least one spring 81, or part thereof, disposed in a plane orthogonal to the axis of the piston 30, said spring 81 being, for example, a single flat spring 81 comprising two concentric annular portions 82*a*, 82*b* interconnected by a plurality of intermediary portions 83, in a spiral arrangement.

As already described for the supporting elastic means 70, for this construction of additional supporting elastic means 80, the shell 10 is formed in at least two coaxial portions hermetically affixed to each other, said at least one spring 81, or part thereof, having one of its annular portions 82*a*, the radially external one, affixed between said two portions of shell.

In this case, the shell 10 presents three coaxial portions hermetically affixed to each other, two of which already described and respectively defined by the elongated tubular body 11 and motor cover 15, and the other coaxial portion being defined by an end portion 16 to be mounted to the cylinder 20, said end portion 16 being provided with an enlarged peripheral edge 17 defining an end flange 17*a*, for the seating and mounting of a flange portion 11*f* of the first end 11*a* of the elongated tubular body 11 of the shell 10. The construction and mounting of this other flat spring 81 follows the same characteristics as that described for the flat spring 71, mounted to the actuating means 50, that is, said other flat spring 81 presents its outermost annular portion 82*a* affixed between the shell portions defined by the elongated tubular body 11 and peripheral edge 17 of the end portion 16.

In this construction of additional supporting elastic means 80, the shell 10 also presents an enlargement of its elongated tubular body 11, adjacent to its first end 11*a*, in the mounting region of the end portion 16.

As already described for the supporting elastic means 70, the additional supporting elastic means 80 can also be defined by at least one cylindrical helical spring 84, coaxial to the axis of the piston 30 and having an end coupled to the latter and an opposite end coupled to the shell 10.

In this case, the cylindrical helical spring 84 can surround an end region of the elastic means 60*a*, adjacent to the actuating means 50, or also said cylindrical helical spring 84 can be configured to be surrounded by said end region of the elastic means 60*a*. The cylindrical helical spring can be provided either in a separate piece or in a single piece with the elastic means 60*a*.

It should be understood that, within the concept of the invention presented herein, other embodiments for the supporting elastic means 70 and additional supporting elastic means 80 (not illustrated) are possible, not presenting the latter simultaneously provided with the same spring construction, such as presenting one of said parts of supporting elastic means 70 and additional supporting elastic means 80 in the form of a flat spring, whilst the other of said parts in the form of a helical spring.

Figure 9:
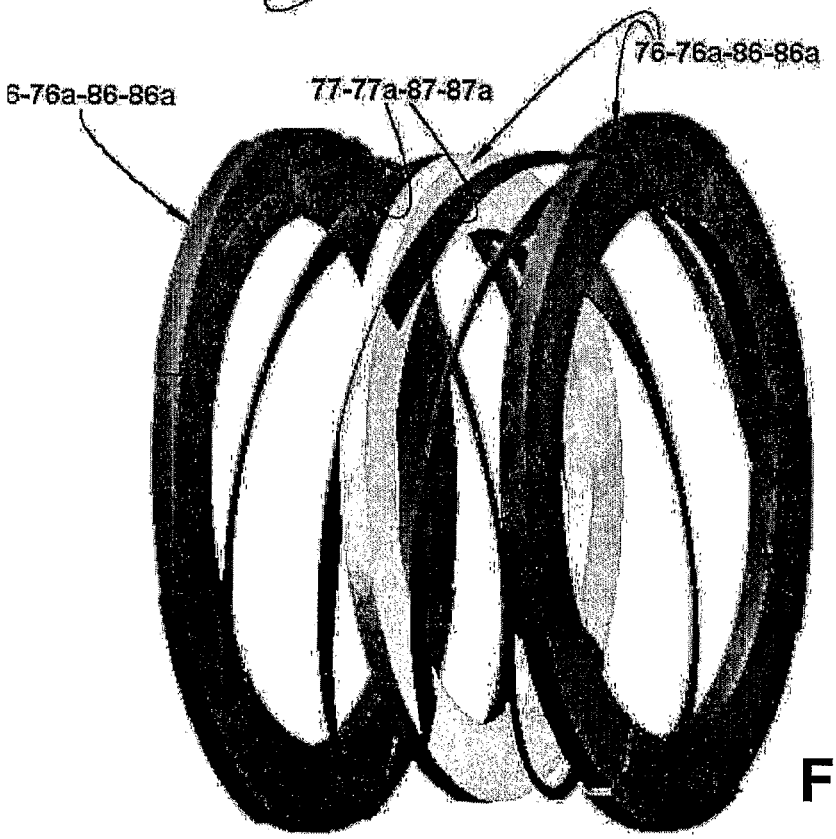
FIG. 9 schematically represents a supporting elastic means for the second constructive option illustrated in FIGS. 7 and 8.

According to the constructive option illustrated in FIG. 9 for the cylindrical helical spring, this comprises coils 76, 86, affixed to each other through helical spring elements 77, 87. In this construction, the cylindrical helical spring is formed by three rings 76*a*, 86*a*, and a plurality of strips 77*a*, 87*a* affixed in slots of the rings. The outer rings are fixed and the central ring is the movable one. In the embodiment in which only one spring is employed to define the supporting elastic means 70, the central ring 76, 76*a*, 86, 86*a* of this helical spring construction is affixed to the actuating means 50, and the two outer rings can be affixed to the shell 10 of the compressor. Likewise, this assembly can be mounted in both sides of the resonant spring, completely supporting the mechanism.

The axial rigidity of the construction presenting the supporting elastic means 70 and the additional supporting elastic means 80 is used to balance the vibration of the compressor. Since the piston 30 and the linear electric motor 40 move coaxially and in opposite directions to each other, the reaction force of one of the supporting elastic means 70 and additional supporting elastic means 80 against the shell 10 of the compressor is nullified by the other of said supporting elastic means 70 and additional supporting elastic means 80 which is operating in the opposite direction. For this neutralization of forces, it is necessary that the product of rigidity×travel of the supporting elastic means (or additional supporting elastic means) be equal for the two supporting elastic means in operation.

The use of the two supporting elastic means can affect the main resonant system of the compressor with the additional rigidity in the ends of said two supporting elastic means. This interference must be limited in order not to interfere in the transfer of energy from the motor to the piston.

The two supporting elastic means described herein can be employed only to support the mechanism at the side of the linear electric motor 40 (supporting elastic means 70), or they can also be employed at the side of the piston 30 (additional supporting elastic means 80) suspending the whole mechanism through springs.

The construction of articulated piston 30 can be used jointly with the two supporting elastic means described herein, in order to prevent mounting misalignments from generating undesired forces on the piston 30.

The advantage of using supporting elastic means is the low energy loss thereof, as it occurs only in a very small degree upon deformation of the spring structure. Since there is no friction between the components, it is not necessary to use oil for operation thereof, which fact, besides the ecological aspect involved, imparts versatility to the compressor application, by allowing said compressor to operate in any position.

The invention claimed is:

1. A linear compressor comprising a shell which affixes, internally, a cylinder defining a compression chamber in whose interior is provided a piston; a linear electric motor having a fixed part internally affixed to the shell and a movable part reciprocating in relation to the fixed part; an actuating means affixed to the movable part of the linear electric motor, to be driven by said movable part in a reciprocating movement; a first cylindrical helical spring coupling the actuating means to the piston, so that said first cylindrical helical spring, said actuating means, and said piston are displaced, as a resonant movable assembly, in a reciprocating movement, during operation of the compressor, wherein the compressor comprises a supporting elastic means is defined by at least one second cylindrical helical spring, which is coaxial to an axis of the fixed part of the linear electric motor and having an end coupled to the actuating means and an opposite end coupled to the shell such that the second cylindrical helical spring connects the actuating means to the shell, wherein a portion of the first cylindrical helical spring is disposed within an inner space of the second cylindrical helical spring, the second cylindrical helical spring providing a radial rigidity capable of supporting lateral loads actuating on the assembly defined by the movable part of the linear electric motor and by the actuating means, so as to minimize axial misalignments between said movable and fixed parts of the linear electric motor, resulting from effects of said lateral loads, said supporting elastic means presenting providing a minimum axial rigidity, so as to allow a desired displacement of the piston and the actuating means.

2. The compressor, as set forth in claim 1, characterized in that the second cylindrical helical spring surrounds an end region of the first cylindrical helical spring, adjacent to the actuating means.

3. The compressor, as set forth in claim 2, further comprising an additional supporting elastic means defined by at least one spring disposed in a plane orthogonal to an axis of the piston.

4. The compressor, as set forth in claim 3, wherein the additional supporting elastic means connects the piston to the shell, wherein the additional supporting elastic means is defined by a single flat spring.

5. The compressor, as set forth in claim 4, characterized in that the single flat spring comprises two concentric annular portions interconnected by a plurality of intermediary portions, in a spiral arrangement.

6. The compressor, as set forth in claim 3, characterized in that the shell is formed in at least two coaxial portions hermetically affixed to each other, said at least one spring having a radially outer portion affixed between said two shell portions.

* * * * *